US006783420B2

(12) United States Patent
Nelson

(10) Patent No.: US 6,783,420 B2
(45) Date of Patent: Aug. 31, 2004

(54) BUILDING TOY KIT, COMPONENT THEREOF, METHOD OF ENHANCING THE GLOW, METHOD OF PACKAGING, AND PACKAGE THEREOF

(76) Inventor: Philip N. Nelson, 4904 Bonaire Dr., Monroe, LA (US) 71203

( * ) Notice: Subject to any disclaimer, the term of this patent is extended or adjusted under 35 U.S.C. 154(b) by 0 days.

(21) Appl. No.: 10/299,035

(22) Filed: Nov. 18, 2002

(65) Prior Publication Data

US 2004/0097164 A1 May 20, 2004

(51) Int. Cl.[7] ..... A63H 33/08
(52) U.S. Cl. ..... 446/108
(58) Field of Search ..... 446/105–112, 117–124, 446/219; 273/156, 157 R; 40/83, 192, 546, 542; 264/80, 162; 206/575; 428/83, 192

(56) References Cited

U.S. PATENT DOCUMENTS 3,905,681 A * 9/1975 Nagel
4,107,869 A * 8/1978 Abrams ..... 46/21
4,989,956 A * 2/1991 Wu et al. ..... 350/345
5,014,455 A * 5/1991 Desaderata ..... 40/539
5,536,558 A * 7/1996 Shelton ..... 428/167
5,649,703 A * 7/1997 Kanbar ..... 273/157 R
5,787,618 A * 8/1998 Mullis ..... 40/219
5,938,497 A * 8/1999 Mott ..... 446/122
6,481,131 B2 * 11/2002 Gianotti et al. ..... 40/546
6,511,073 B2 * 1/2003 Simonds ..... 273/299

* cited by examiner

*Primary Examiner*—Jacob K. Ackun
*Assistant Examiner*—Jamila Williams
(74) *Attorney, Agent, or Firm*—Rossi & Associates

(57) ABSTRACT

A toy component can be made of a fluorescent material, such as fluorescent acrylic, where the property of the material is such that the peripheral end glows when light is incident on the planar surface. To enhance the glow effect, the peripheral end is routed smooth and/or flame polished. The toy component can have various configurations, including an angled configuration, which can be formed by bending a planar acrylic sheet with heat. The toy components can be packaged economically and compactly.

8 Claims, 9 Drawing Sheets

BUILDING TOY KIT, COMPONENT THEREOF, METHOD OF ENHANCING THE GLOW, METHOD OF PACKAGING, AND PACKAGE THEREOF

BACKGROUND

Building or educational toys for constructing various types of structures generally are packaged in a kit form. Such a kit can have a variety of structural components, including fasteners, accessories, and tools. A marketing research shows that kids are highly imaginative and can use their imagination to build whatever structure they desire, such as church, fort, ramp, dog pen, tent, barricade, heliport, etc., for example, when playing with action figures, dolls, etc. The toy components need not be elaborate and expensive for kids to have fun. The complexity of some of today's toys can deter kids from playing with them.

It would be desirable to develop a simple and yet entertaining constructional toy that will entertain kids or even adults, and a simple way of packaging such a toy. The present invention addresses this need.

SUMMARY

The present invention relates to a toy, in particular, a building toy kit, and a method of forming such a toy, and a packaging method and a package thereof.

One aspect of the present invention is a toy component. The toy component can be any object having a planar section with a planar surface and at least one peripheral end. The peripheral end glows when light is incident on the planar surface. In this respect, at least the planar section can be formed of a material that propagates light incident on the planar surface to the peripheral end. One such material can be fluorescent acrylic.

The object can be a planar rectangular member that forms the planar section, which can have four corners and four peripheral ends that glow when light is incident on the planar surface. The corners and the peripheral ends can be rounded, such as by routing and/or flame polishing. The rounded comers and peripheral ends can be flame polished to enhance the glow.

The object also can be an angled member having a pair of planar sections extending outwardly at an angle from a common intersection (apex). Each of the planar sections can have two comers and three peripheral ends that glow when light is incident on any of the planar surfaces. All four corners and the peripheral ends can be rounded, such as by routing, and can be flame polished to enhance the glow.

Another aspect of the present invention is a building toy kit. This kit contains at least two differently shaped objects, such as those described above, with each having the toy component features described above.

Another aspect of the present invention is a toy kit package for the above described toy kit including an open carton and a shrink wrap for maintaining the objects and the open carton together. Specifically, a toy kit can include a plurality of first angled members, at least a pair of second angled members, and a plurality of planar members. The first angled members each can have a pair of planar sections extending outwardly at an angle of substantially less than 90°, such as 42°. The second angled members each can have a pair of planar sections extending outwardly substantially at a right angle. The second angled members can be seated in the carton so that one of the planar sections of one of the second angled members can rest on a bottom of the carton and one of the planar sections of the other of the second angled members can be stacked on top of the one planar section of the one second angled member, with the other planar sections of the second angled members spaced apart and facing each other. The first angled members can be stacked and positioned between the other planar sections of the second angled members so that they can rest on the one planar section of the other second angled member. At least one of the planar members can be slid into the carton from each side facing the profile of the stacked first angled members.

The height or length of the planar members and the stacked first angled members can be at about the same level. The height or depth of the carton can be less than half the height or length of the planar members or the stacked first angled members, but greater than half the height of the second angled members.

Another aspect of the present invention is a method of packaging the toy kit described above. One of the second angled members can be seated in an open carton, with one of the planar sections thereof resting on a bottom of the carton. The other of the second angled members can be seated in the carton, with one of the planar sections thereof stacked on top of the one planar section of the one second angled member, and with the other planar sections of the second angled members spaced apart and facing each other. The first angled members can be stacked and positioned between the other planar sections of the second angled members so that the stacked first angled members rest on the one planar section of the other second angled member. At least one of the planar members can be placed in the carton on each side of the stacked first angled members, facing the profile thereof. The toy kit can be shrink wrapped together with the container.

Yet another aspect of the present invention is a method of enhancing the glow at a peripheral end of a planar fluorescent acrylic sheet. To enhance the glow, the peripheral end can be rounded and then flame polished. The peripheral end can be rounded smooth by routing and/or flame polishing the peripheral end.

BRIEF DESCRIPTION OF THE INVENTION

These and other features, aspects, and advantages of the present invention will become more apparent from the following description, appended claims, and accompanying exemplary embodiments shown in the drawings, which are briefly described below.

FIG. 1 is a perspective view of a structure formed of a toy kit according to the present invention.

FIG. 1 A illustrates a rounded end of a component of the toy kit of FIG. 1.

FIG. 2B illustrates a top view of the angled component of FIG. 2.

DETAILED DESCRIPTION

Figure 1:
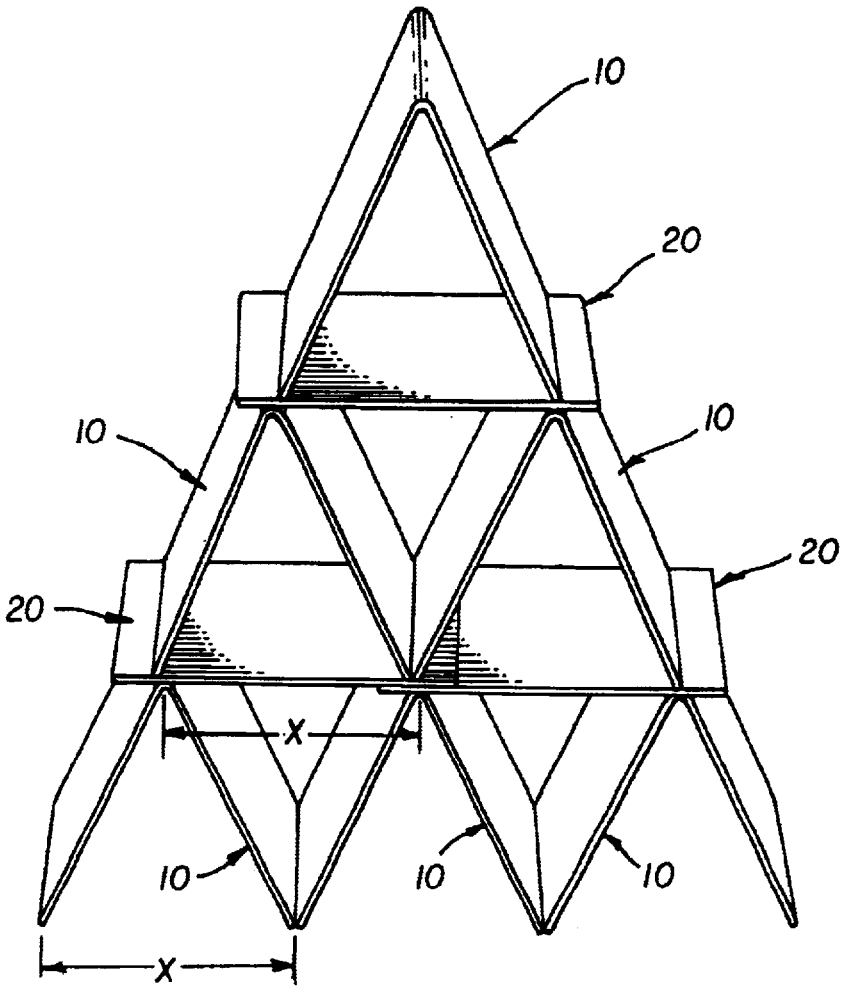

The present toy component can be made of durable plastic material that glows at least at its peripheral end. One commercially available material suitable for the present toy is acrylic, commonly known as PLEXIGLAS. This material comes in many different colors and opacity, including fluorescent colored sheets or resins (which can be injection molded to a desired shape). The present inventor finds the fluorescent colors to be most appealing. The fluorescent colors can come in many colors. In particular, acrylic has unique light propagating properties that allow fluorescent acrylic sheet to glow at its peripheral ends, particularly when the ends are finished smooth, such as by routing and/or flame polishing to enhance the glow at the peripheral ends. That is, when light is incident on a planar surface of the acrylic sheet, the light propagates to the peripheral ends, giving that glow look thereabout. Specifically, referring to FIG. 1A, the properties of acrylic sheet is such that light entering from its major planar sides reflects internally until it exits the peripheral ends, namely the sides extending between its major planar sides. That is, much of the light entering through either of the major planar sides reflect internally, and little light exits through the major planar sides. The glow at the peripheral ends can be enhanced by routing and/or flame polishing the peripheral ends, including the corners. By rounding and smoothing the peripheral ends, the surface area through which light can exit increases to enhance the glow. That is, the peripheral end having a flat surface has a lesser area than the same end that is rounded, as illustrated in FIG. 1A.

The glowing ends indeed can be eye appealing and soothing. This glowing phenomenon will certainly draw attention to kids and make them want to play with the toy. In this regard, the present invention is drawn to a toy that incorporates a simple fluorescent component. The present toy is based on a simple and yet entertaining constructional component that can entertain kids and even adults with its shapes and colors. Moreover, the toys components are configured to be packaged into a relatively compact size, which is suitable for shipping or portability.

Planar acrylic sheets can be formed to various shapes and configurations. FIGS. 1–5A merely illustrate some examples of simple building components made of a fluorescent material, namely from an acrylic sheet or resin, which is extremely durable and strong. The same or corresponding elements are labeled with the same reference numerals.

Figures 2, 2A:
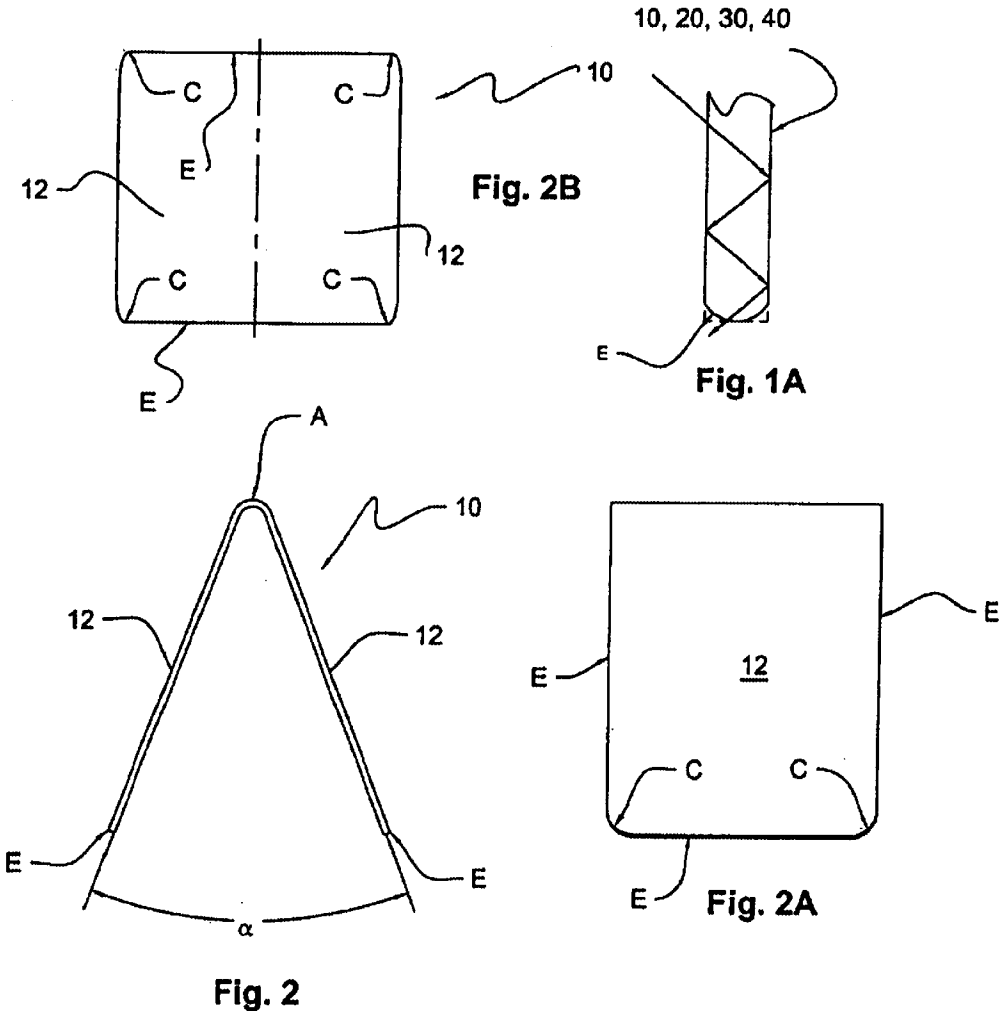
FIG. 2 illustrates a profile of an angled or shaped component of the construction toy used in FIG. 1.
FIG. 2A illustrates a side view of the angled component of FIG. 2.
Figure 5A:
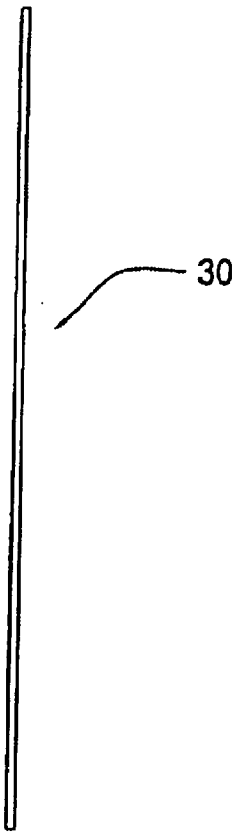
FIG. 5A illustrates a profile of the planar component of FIG. 5.
Figure 5:
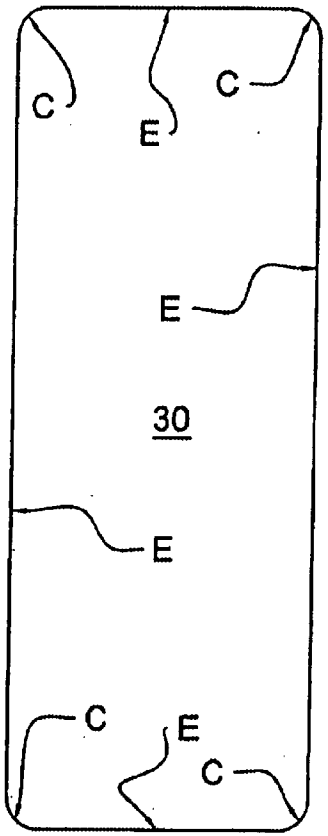
FIG. 5 illustrates another embodiment of the planar component, which is similar to the one shown in FIG. 4 but having a different dimension.
Figure 4A:
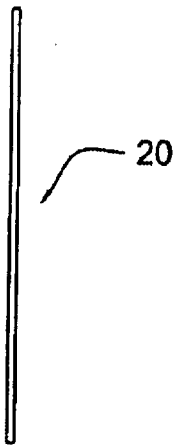
FIG. 4A illustrates a profile of the planar component of FIG. 4.
Figure 4:
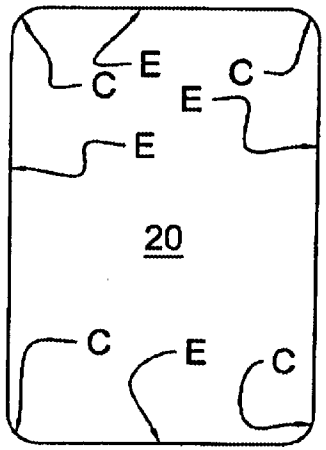
FIG. 4 illustrates a planar component of the construction toy used in FIG. 1.

FIG. 1 illustrates a pyramid structure built using merely two differently shaped components, namely an angled object or component 10 illustrated in FIGS. 2–2B and a planar object or component 20 illustrated in FIGS. 4–4A. Specifically, the illustrated pyramid structure includes as its bottom layer three side-by-side positioned angled components 10, each with its open end facing downwardly on a flat area. Two planar components 20 rest on the top or apex of the angled components, with the facing ends overlapping. Instead of the two overlapping planar components, a single longer planar component 30, such as shown in FIGS. 5–5A can be used as a third component. The next layer comprising two angled components are laid on top of the planar components 20, and a single planar component 20 can rest on the pair of angled components 10. The pyramid structure can be completed with a single angled component 10 resting on the single planar component 20.

Referring to FIGS. 4–5A, the planar components 20, 30 each can be formed of a rectangular or substantially rectangular sheet of acrylic. Its four corners C can be rounded smooth, such as by routing and/or flame polishing to enhance the glow effect at its peripheral ends. The four ends E then can be further mechanically or manually polished or buffed smooth, if more glow effect is desired.

Figure 3A:
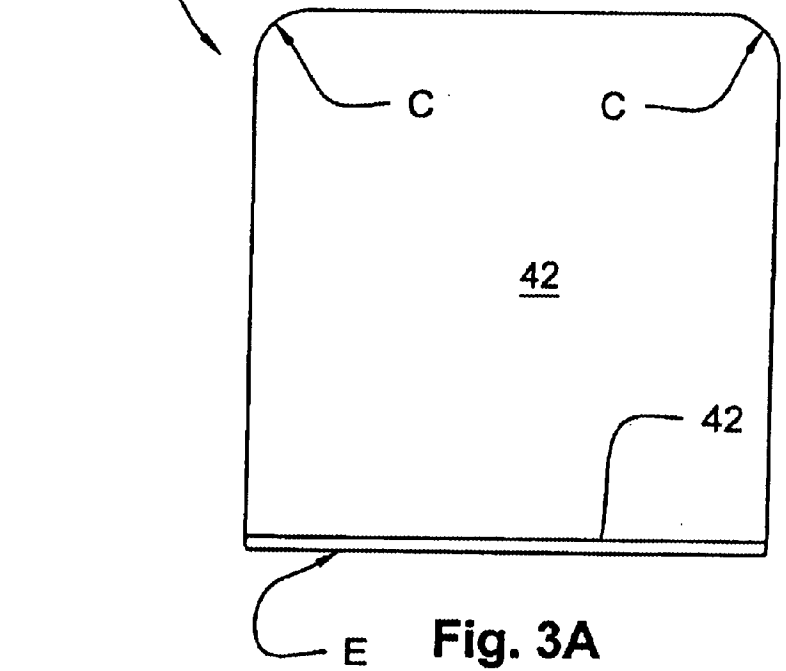
FIG. 3A illustrates a side view of the angled component of FIG. 3.
Figure 3:
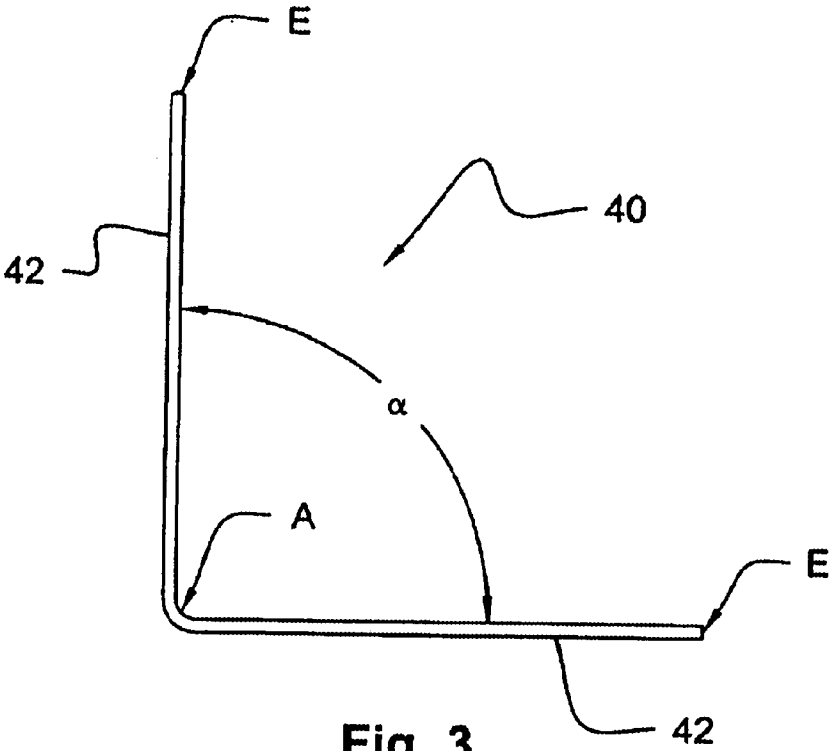
FIG. 3 illustrates a profile of another embodiment of the angled component, which is similar to the one shown in FIG. 2 but with different angling.

Referring to FIGS. 2–3A, the angled components 10 and 40 each comprise a pair of planar leg sections 12, 42 extending outwardly from an apex A. Each of the leg sections 12, 42 has a free peripheral end E. These ends E can be parallel or substantially parallel to each other, and can be parallel or substantially parallel to the apex A. Moreover, all four corners C can be rounded smooth, such as by routing and/or flame polishing. Then, the entire peripheral ends E can be rounded smooth by routing and/or flame polishing to enhance the glow effect. The four corners can be rounded either before or after the bending step. It would be easier, however, to round the corners before the sheet is half folded. In this respect, a rectangular planar acrylic sheet can be prepared as a starting material as disclosed above for forming the planar component 20, 30, and the resulting product can be folded in half. For instance, a rectangular planar acrylic sheet can be bent along its half length by heating its mid-section to about 180° F., which softens the mid-section, to form the leg sections. The leg sections can be held to any desired angle $\alpha$, such as 30°–45°, 90°, until the sheet is cooled, such as using a jig or other conventional tooling. After rounding the four corners (two at each leg section 12), such as by routing, buffing, and/or flame polishing to enhance the glow at the rounded edges or ends.

In the illustrated embodiment, the angle $\alpha$ of the shaped component between its two planar leg sections 12, 42 can be configured so that the distance X between the apexes A of a side-by-side positioned pair of angled components 10, 40 are substantially equal to the distance X between the width of the opening between the free ends E of the leg sections 12, 42. The distance X, however, need not be equal, as other configurations can be used. Moreover, the leg sections need not be symmetrical with each other. The $\alpha$ in the embodiment of FIGS. 2–2B can be about 45° and in the embodiment of FIGS. 3–3A can be about 90 °.

While the methods of enhancing the glow and bending acrylic is disclosed for forming a toy component, these methods can be applied at least to all acrylic products and all products made of similar plastic materials having the same or similar properties. Indeed, given the disclosure of the present invention, one versed in the art would appreciate that there may be other embodiments and modifications within the scope and spirit of the present invention.

It is highly desirable for the present toy kit to be packaged compactly and economically. The present inventor has found an economical way of packaging such a present toy kit. The components of the toy kit are positioned in such a way that they fold into an open container or carton, which maintains the components in the folded position while the package can be wrapped or shrink wrapped. In particular, FIGS. 6–10 illustrate an example of the present method of packaging the toy kit.

Figure 6:
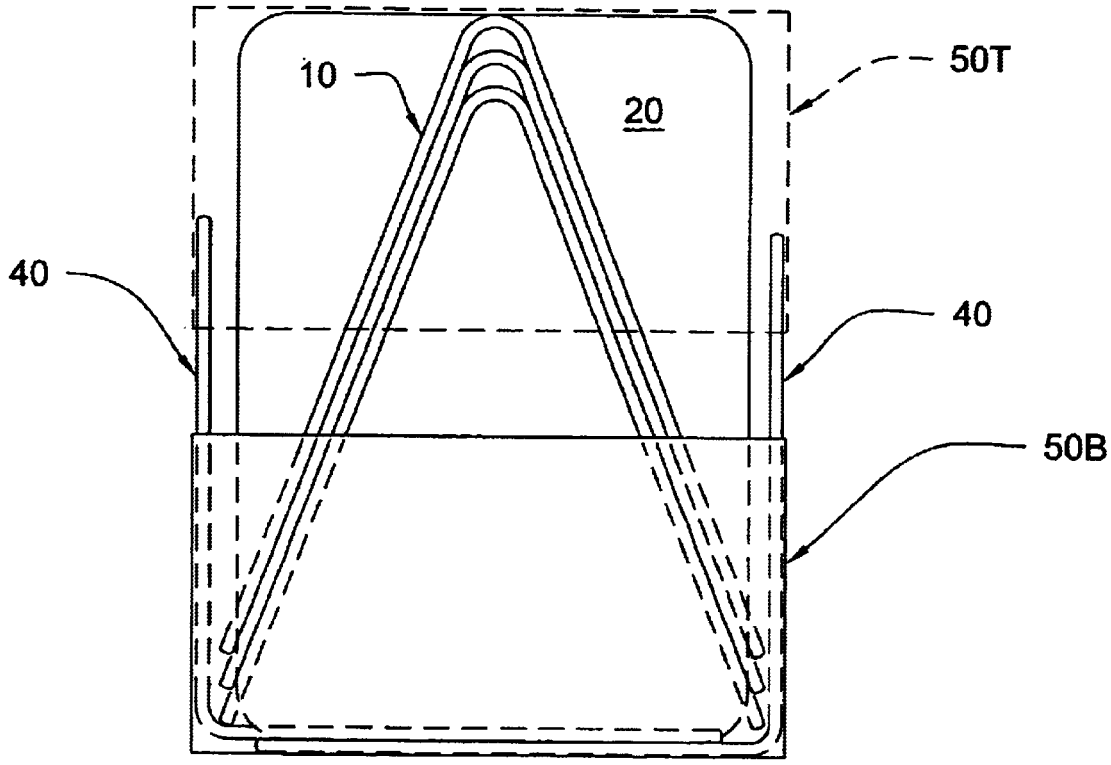
FIG. 6 illustrates one side view of the toy kit assembled for packaging.
Figure 10:
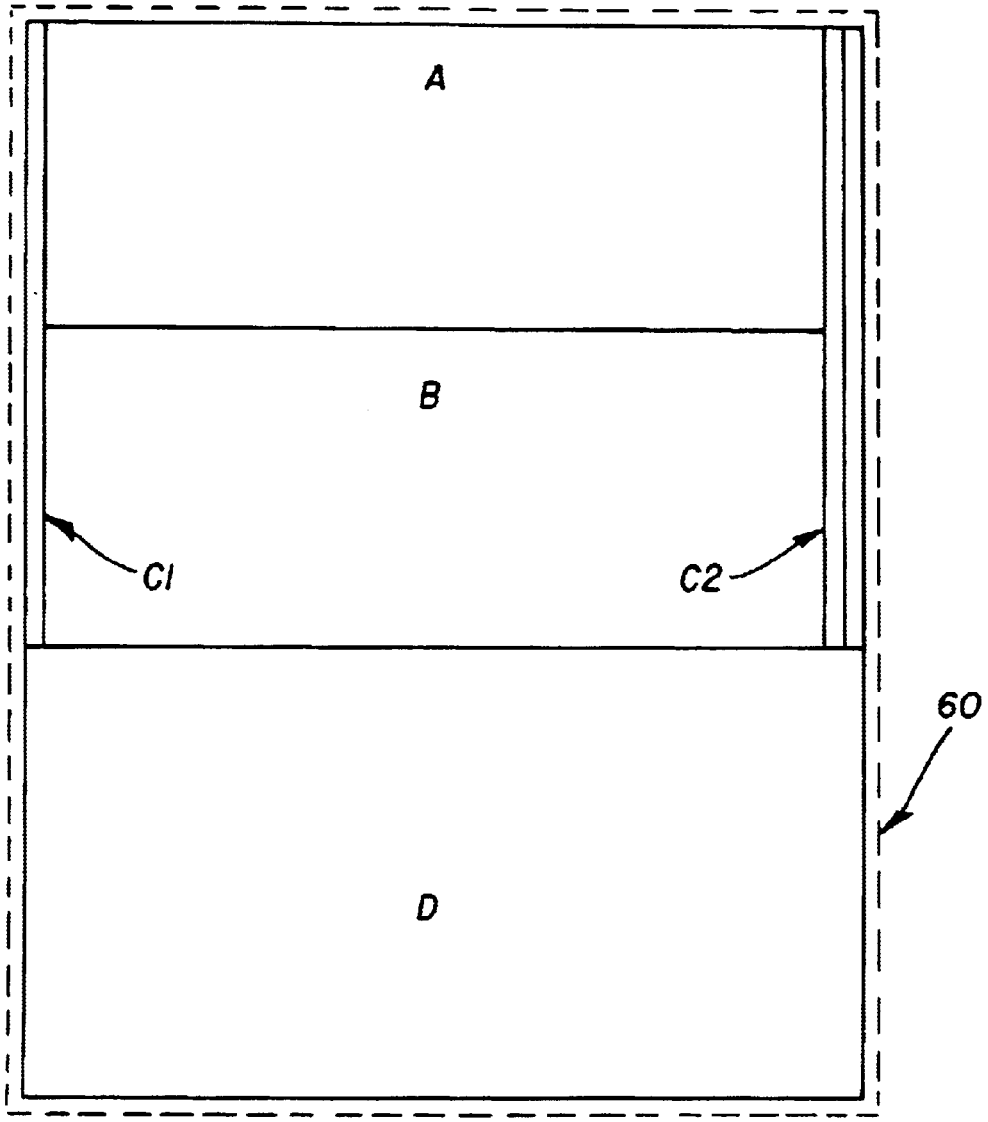
FIG. 10 illustrates the shrink wrapped package assembly of FIG. 6.

As illustrated in FIG. 6, the package includes a toy kit folded and placed in an open carton 50B. The package can be shrink wrapped as schematically illustrated in FIG. 10. This package can be configured so that it can be stacked with one another in a shipping box, which can easily fit on a conventional shipping pallet.

Figure 7:
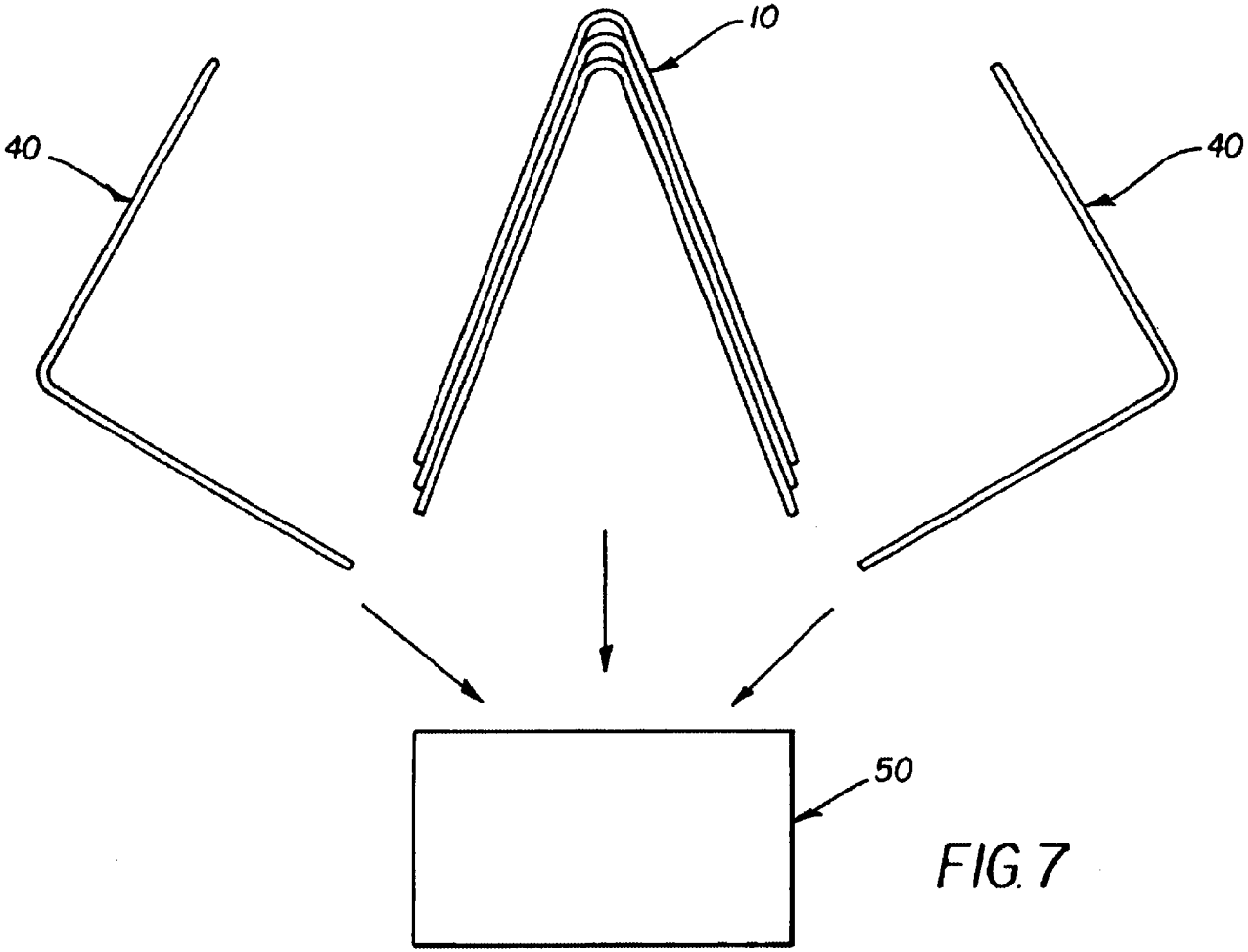
FIG. 7 illustrates an exploded view of the packaging assembly of FIG. 6.

FIG. 7 more clearly illustrates how the toy kit is assembled in the open carton 50B, which essentially acts to maintain the toy kit in the assembled position while the package can be shrink wrapped. In this respect, the open carton 50B can be configured as a box with an open top, namely having a square or rectangular bottom joined to four upright sides, with the vertical sides of upright joined to the adjacent vertical sides of the adjacent uprights. The carton 50B can be made of paper, plastic, or wood, or preferably of any durable material so that it can be used for storing and carrying the toy kit by the end user. As illustrated, the packaged toy kit comprises a plurality of angled components 10, 40 and planar components 20. It should be noted that this is merely one example of the packaging configuration.

Figure 8:
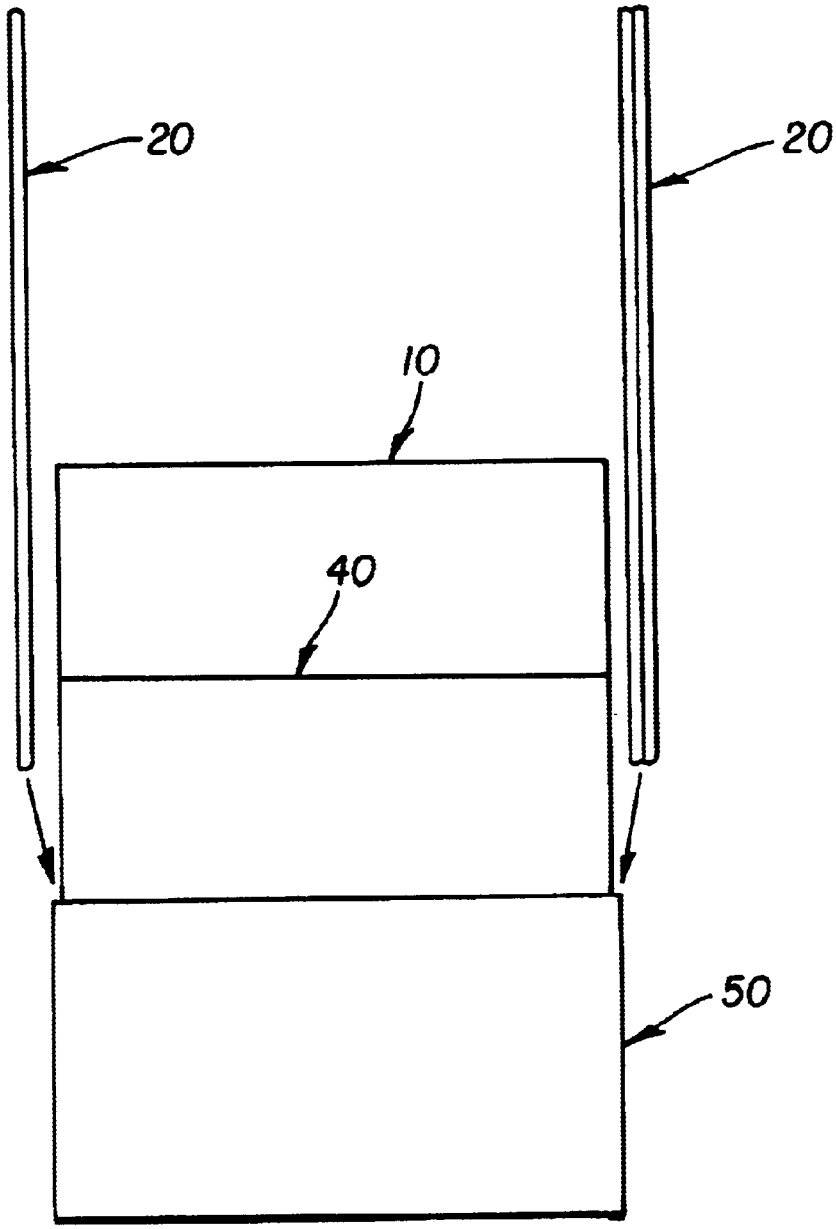
FIG. 8 illustrates a partial exploded view of the packing assembly of FIG. 6 as viewed from the right or left side of FIG. 6.
Figure 9:
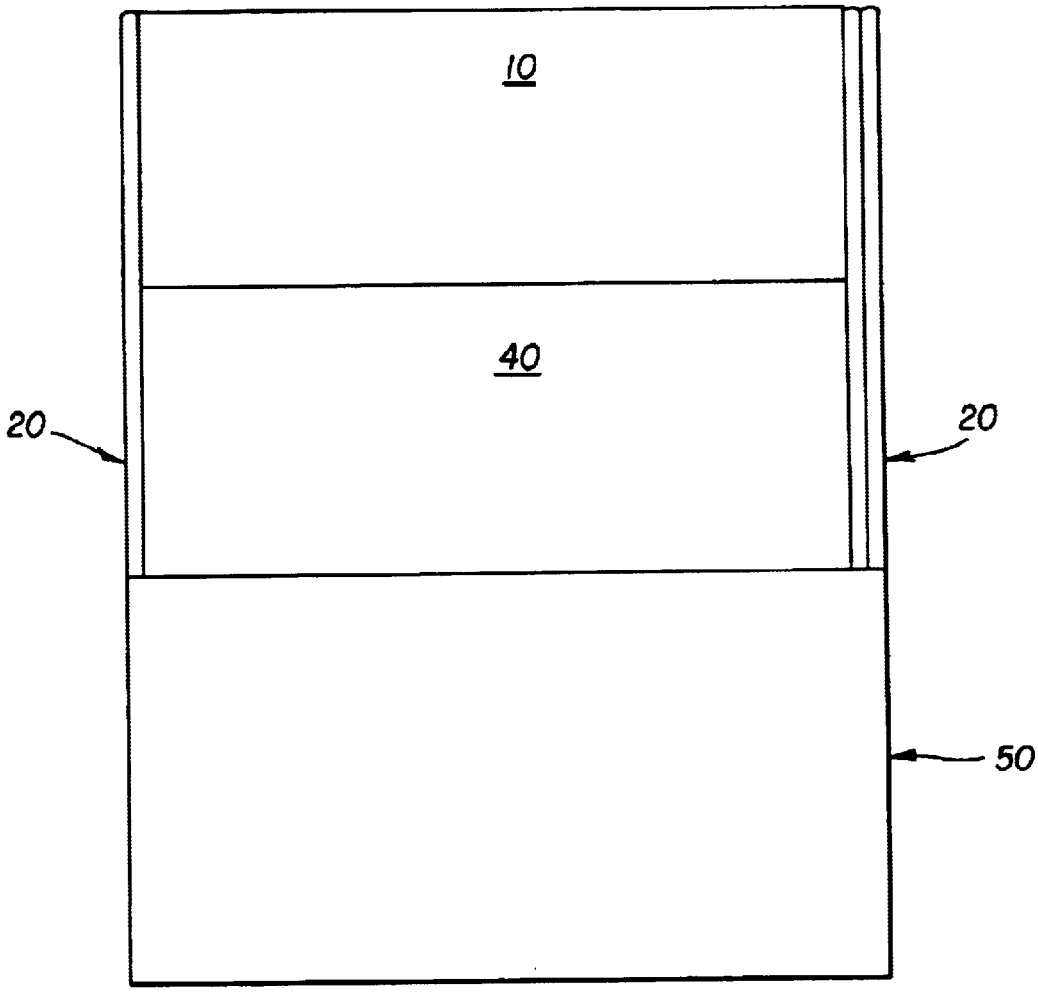
FIG. 9 illustrates the package assembly of FIG. 6 as viewed from the right or left side of FIG. 6.

Still referring to FIG. 7, the package can be formed by inserting at least a pair of 90° angled components 40 into the carton 50B so that one leg 42 of one angled component 40 rests at the bottom of the carton 50B and one leg 42 of the other angled component 40 is stacked on top of the one leg of the one angled component, with the other legs of the two angled components spaced apart and facing each other, as illustrated in FIG. 6. Then, the stacked angled components (three illustrated) 10 can be positioned between the angled components 40 and to rest on the stacked legs of the angled components 40, as illustrated in FIG. 6. Thereafter, one or more of the planar component 20 can be slid into each side facing the profile of the stacked angled components 10, as illustrated in FIGS. 8 and 9. When all the components are inserted into the carton 50B, the height of the planar components 20 and the angled components 10 can be made to be at about the same level. When the package is shrink wrapped, it can be stacked on one another for ease of shipment.

The illustrated embodiment uses an open carton 50B for supporting package from the bottom. If desired, the same or similar open carton 50T (shown in phantom in FIG. 6) can be placed over the top portion of the package to make the package sturdier and more uniform for ease of stacking. Preferably, the height of the open carton 50B, 50T is less than half the height or length of the planar component 20 or the stacked angled components 10, but greater than half the height of the angled component 40.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set in the appended claims.

I claim:

1. A building toy kit comprising:

at least two differently shaped independent objects, at least one of the objects being a planar member, and at least one of the object being an angled member including a pair of planar sections extending outwardly from one another at an angle;

wherein the planar member includes first and second planar surfaces and exposed peripheral ends;

wherein each of the planar sections of the angled member includes first and second planar surfaces and exposed peripheral ends; and wherein the planar member and the angled member are formed of a material that propagates light incident on their respective planar surfaces to the peripheral ends thereof.

2. A building toy kit according to claim 1, wherein the material is fluorescent acrylic.

3. A building toy kit according to claim 1, wherein the planar member has four corners and four peripheral ends that glow when light is incident on the planar surface thereof.

4. A building toy kit according to claim 3, wherein the four corners and the peripheral ends of the planar member are rounded.

5. A building toy kit according to claim 4, wherein the four corners and the peripheral ends are routed smooth or flame polished to enhance the glow.

6. A building toy kit according to claim 1, wherein each of the planar sections of the angled member has two corners and three peripheral ends that glow when light is incident on the planar surface thereof.

7. A building toy kit according to claim 6, wherein all the corners and the peripheral ends of the planar sections are rounded.

8. A building toy kit according to claim 7, wherein all the corners and the peripheral ends are routed smooth or flame polished to enhance the glow.

* * * * *